US009091068B2

(12) United States Patent
Fielder

(10) Patent No.: US 9,091,068 B2
(45) Date of Patent: Jul. 28, 2015

(54) WALL CONSTRUCTION SYSTEM, WALL STUD, AND METHOD OF INSTALLATION

(75) Inventor: Werner Fielder, Bulla (AU)

(73) Assignee: Safari Heights PTY LTD, Victoria (AU)

( * ) Notice: Subject to any disclaimer, the term of this patent is extended or adjusted under 35 U.S.C. 154(b) by 0 days.

(21) Appl. No.: 14/127,793

(22) PCT Filed: Jun. 20, 2012

(86) PCT No.: PCT/AU2012/000706

§ 371 (c)(1),
(2), (4) Date: Dec. 19, 2013

(87) PCT Pub. No.: WO2012/174589

PCT Pub. Date: Dec. 27, 2012

(65) Prior Publication Data

US 2014/0109503 A1 Apr. 24, 2014

(30) Foreign Application Priority Data

Jun. 20, 2011 (AU) ..... 2011902404

(51) Int. Cl.

| | |
|---|---|
| ***E04C 3/00*** | (2006.01) |
| ***E04C 3/28*** | (2006.01) |
| ***E04B 2/86*** | (2006.01) |
| ***E04C 5/16*** | (2006.01) |
| ***E04B 2/54*** | (2006.01) |
| *E04C 3/04* | (2006.01) |

(52) U.S. Cl.

CPC ... *E04C 3/28* (2013.01); *E04B 2/54* (2013.01); *E04B 2/8611* (2013.01); *E04B 2/8635* (2013.01); *E04C 5/168* (2013.01); *E04C 2003/0452* (2013.01)

(58) Field of Classification Search

CPC ..... E04B 2/55; E04B 2/60; E04B 2/7872; E04B 2/8611; E04B 2/54; E04B 2/8635; E04C 3/28; E04C 5/168; E04C 2003/0452

USPC ..... 52/309.12–309.17, 357–360, 425–427, 52/435, 481.1, 837, 839

See application file for complete search history.

(56) References Cited

U.S. PATENT DOCUMENTS

| | | | | | |
|---|---|---|---|---|---|
| 1,923,906 | A | * | 8/1933 | Berger | 52/356 |
| 2,141,919 | A | * | 12/1938 | Felix | 52/481.1 |
| RE22,562 | E | * | 11/1944 | Kautz | 248/235 |
| 3,243,930 | A | * | 4/1966 | Slowinski | 52/364 |
| 4,288,962 | A | * | 9/1981 | Kavanaugh | 52/742.13 |

(Continued)

FOREIGN PATENT DOCUMENTS

| | | | |
|---|---|---|---|
| AU | 2009101212 | A4 | 12/2009 |
| CN | 2216094 | Y | 12/1995 |

(Continued)

*Primary Examiner* — Adriana Figueroa

(74) *Attorney, Agent, or Firm* — Patterson Thuente Pedersen, P.A.

(57) ABSTRACT

A wall stud for positioning between an opposing pair of formwork boards. The wall stud including a body and two side walls located on opposing sides of the body. Each side wall having an inner face and an outer face, wherein: the body has at least one opening adapted to receive at least one reinforcing rod. The outer face of the side walls are securable to a formwork board, and the body is affixed to approximately the center of the inner face of each side wall so that a horizontal cross-section of the stud is substantially an H shape.

13 Claims, 12 Drawing Sheets

(56) References Cited

U.S. PATENT DOCUMENTS

| | | | | | |
|---|---|---|---|---|---|
| 4,793,113 | A | * | 12/1988 | Bodnar | 52/481.1 |
| 4,957,272 | A | * | 9/1990 | Lee | 249/196 |
| 5,216,859 | A | * | 6/1993 | Moreno et al. | 52/238.1 |
| 5,279,091 | A | * | 1/1994 | Williams et al. | 52/489.2 |
| 5,595,040 | A | * | 1/1997 | Chen | 52/837 |
| 5,625,989 | A | * | 5/1997 | Brubaker et al. | 52/309.12 |
| 5,660,017 | A | * | 8/1997 | Houghton | 52/655.1 |
| 5,680,738 | A | * | 10/1997 | Allen et al. | 52/837 |
| 5,695,676 | A | * | 12/1997 | Lee | 249/40 |
| 6,250,033 | B1 | * | 6/2001 | Zelinsky | 52/275 |
| 6,591,573 | B2 | * | 7/2003 | Houghton | 52/656.9 |
| 7,032,357 | B2 | * | 4/2006 | Cooper et al. | 52/426 |
| 7,047,695 | B2 | * | 5/2006 | Allen et al. | 52/120 |
| 7,059,577 | B1 | * | 6/2006 | Burgett | 249/40 |
| 7,284,351 | B2 | * | 10/2007 | Cooper et al. | 52/424 |
| 7,654,052 | B2 | * | 2/2010 | Cooper et al. | 52/309.11 |
| 7,882,672 | B2 | * | 2/2011 | Emblin | 52/426 |
| 8,176,696 | B2 | * | 5/2012 | Leblang | 52/309.12 |
| 8,225,581 | B2 | * | 7/2012 | Strickland et al. | 52/850 |
| 2004/0016194 | A1 | | 1/2004 | Stefanutti et al. | |
| 2008/0104911 | A1 | * | 5/2008 | Jarvie et al. | 52/309.1 |
| 2009/0235601 | A1 | * | 9/2009 | Mellett | 52/426 |
| 2009/0276988 | A1 | | 11/2009 | Garza | |

FOREIGN PATENT DOCUMENTS

| | | | | |
|---|---|---|---|---|
| CN | 2856237 | Y | | 1/2007 |
| SE | 50635 | A1 | * | 4/1981 |

* cited by examiner

WALL CONSTRUCTION SYSTEM, WALL STUD, AND METHOD OF INSTALLATION

PRIORITY CLAIM

The present application is a National Phase entry of PCT Application No. PCT/AU2012/000706, filed Jun. 20, 2012, which claims priority to Australian Application No. 201190404, filed Jun. 20, 2011, said applications being hereby incorporated by reference herein in their entirety.

FIELD OF THE INVENTION

This invention relates in general to concrete wall production, and more particularly to a wall stud, and wall construction system, preferably made from plastic.

BACKGROUND TO THE INVENTION

To erect a vertical concrete wall, pre-cast tilt-up concrete panels are commonly used. Another commonly used technique is to use formwork in-situ to support the concrete and reinforcing bars until the concrete has set and cured, after which the formwork is removed.

An alternative way of constructing walls is to manufacture hollow panels which can be manufactured off site, delivered to the building site, erected and filled with concrete on site. These hollow panels consist of two formwork wall board sheets separated by spacers which hold both the vertical and horizontal bars in correct alignment and facilitate the flow of concrete. These panels are then sacrificed as they remain in place and their surface acts as the interior and exterior surfaces of the wall. When erecting these hollow panels, vertical aluminium or galvanised steel studs can be used to support the formwork wall board sheets and position and hold the horizontal and vertical steel reinforcing bars within the formwork prior to the concrete being poured. Aluminium and steel stud frames have the disadvantage of being heavy making the panels difficult to handle. Panels are also prone to distortion due to the flexibility of the studs. In addition, the steel frames can be prone to rusting as the outer edge of the steel studs are not covered by concrete, only by the formwork wall board sheet. Further, the aluminium frames can corrode when in contact with concrete.

Another way of constructing walls is to position box or cube shaped spacers between opposing formwork boards in a spaced relationship. Vertical and horizontal reinforcing rods are then placed through each of the wall spacers to keep the wall construction aligned while the concrete is poured. Operators using this system often misalign or incorrectly place the box shaped spacers making it difficult to place the reinforcing bars in the formwork. Further, due to this wall construction system requiring a disposable template for the accurate positioning of box spacers, the system is difficult to automate.

Discussion or mention of any piece of prior art in this specification is not to be taken as an admission that the prior art is part of the common general knowledge of the skilled addressee of the specification in Australia or any other country.

It would be advantageous to provide an improved, inexpensive, easily constructed and lightweight means of constructing a concrete wall.

SUMMARY OF THE INVENTION

According to one aspect of the present invention there is provided a wall stud for positioning between an opposing pair of formwork boards. The wall stud includes a body, a plurality of ribs and two side walls located on opposing sides of the body, each side wall having an inner face and an outer face. The stud body has at least one opening adapted to receive at least one reinforcing rod, thereby advantageously accurately holding the reinforcing rods in place. The stud body is positioned approximately in the centre of the inner face of each side wall so that a horizontal cross-section of the stud is substantially an H shape. Each of the plurality of ribs is located between the two side walls on a side of the body substantially perpendicular to the body. The outer faces of the side walls are securable to a said formwork board.

Preferably the body, the plurality of ribs and the two side walls are integrally formed to form the wall stud.

The outer face of the side wall preferably has an etched surface. The outer face may also have at least one cut away part, preferably in the shape of a dove tail.

The wall stud preferably also includes two joiner sections located at opposing ends of the wall stud.

According to another aspect of the present invention there is provided a wall stud assembly including: at least one wall stud as described above; and a stud joiner clip for securing the joiner section of the wall stud to another wall stud.

The wall stud and stud joiner clip are preferably formed from a polymer material such as plastic, or other such material. This advantageously makes the wall stud and stud joiner clip light weight, easy to install, very rigid and ensures they will not rust or corrode.

According to yet another aspect of the present invention there is provided a method of wall construction including the steps of: erecting at least one formwork structure including an opposing pair of formwork boards and at least one wall stud assembly as described above located in spaced relationship between the formwork boards; placing reinforcing rods through at least one opening of each of the wall studs; and filling the cavity in between the formwork boards with wall material, preferably concrete.

The method may also further include the step of securing at least a pair of said wall studs together using said stud joiner clip.

According to still a further aspect of the present invention there is provided a wall constructed according to the method described above.

The wall construction installation according to the present invention advantageously reduces the weight of the formwork structure, ensures accurate placement of horizontal and vertical reinforcing bars and because of their rigid structure prevent distortion, twisting and shear movement of the panels, facilitating construction of the concrete wall.

BRIEF DESCRIPTION OF THE DRAWINGS

It will be convenient to further describe the invention with respect to the accompanying drawings which illustrate preferred embodiments thereof. Other embodiments of the invention are possible, and consequently, the particularity of the accompanying drawings is not to be understood as superseding the generality of the preceding description of the invention.

DETAILED DESCRIPTION OF PREFERRED EMBODIMENT

Embodiments of the method of wall construction, the wall stud, and wall stud assembly, including a stud joiner clip will now be described with reference to the accompanying drawings.

Figure 1:
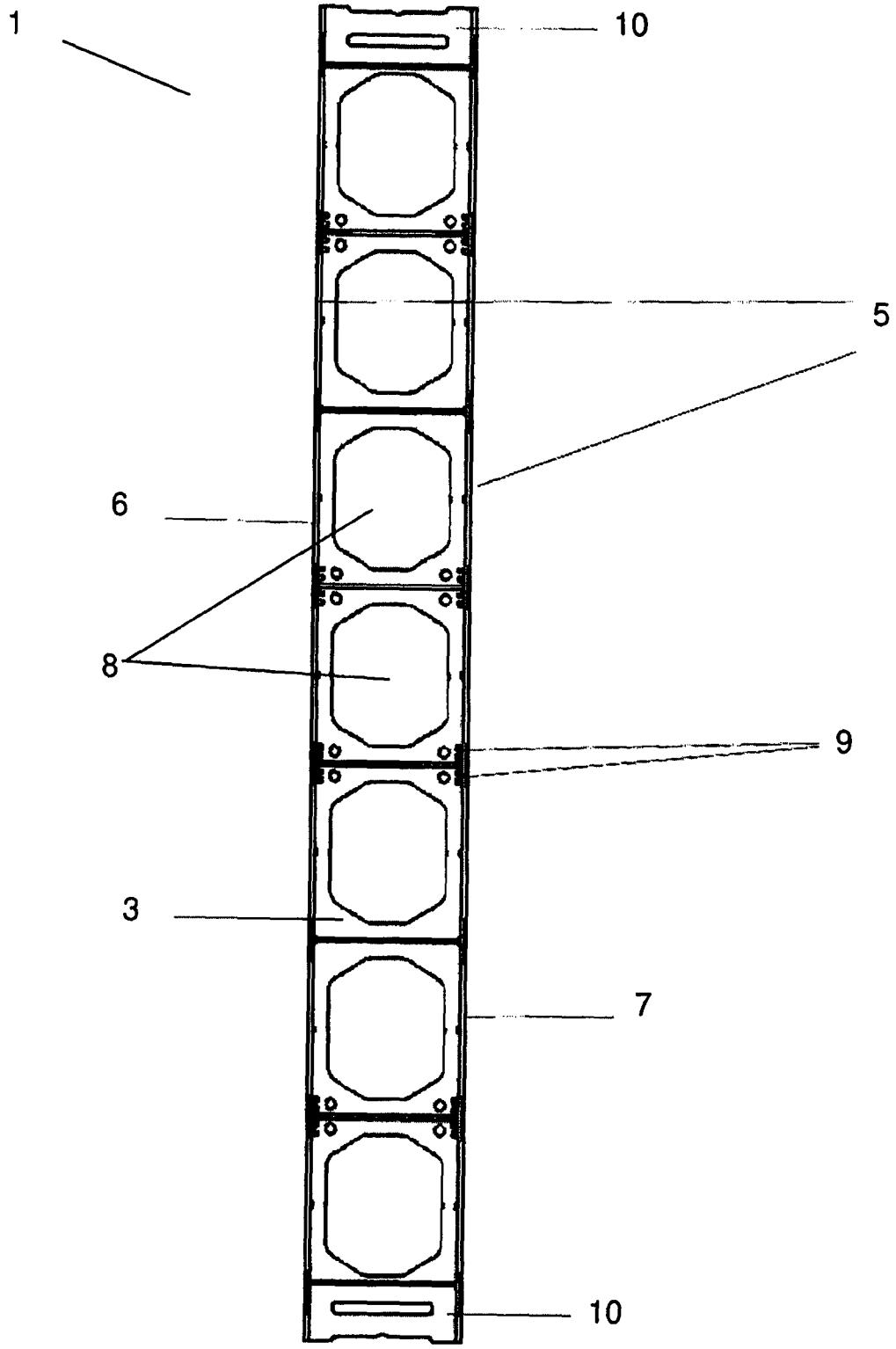
FIG. 1 is a front view of a wall stud in accordance with an embodiment of the present invention.
Figure 2:
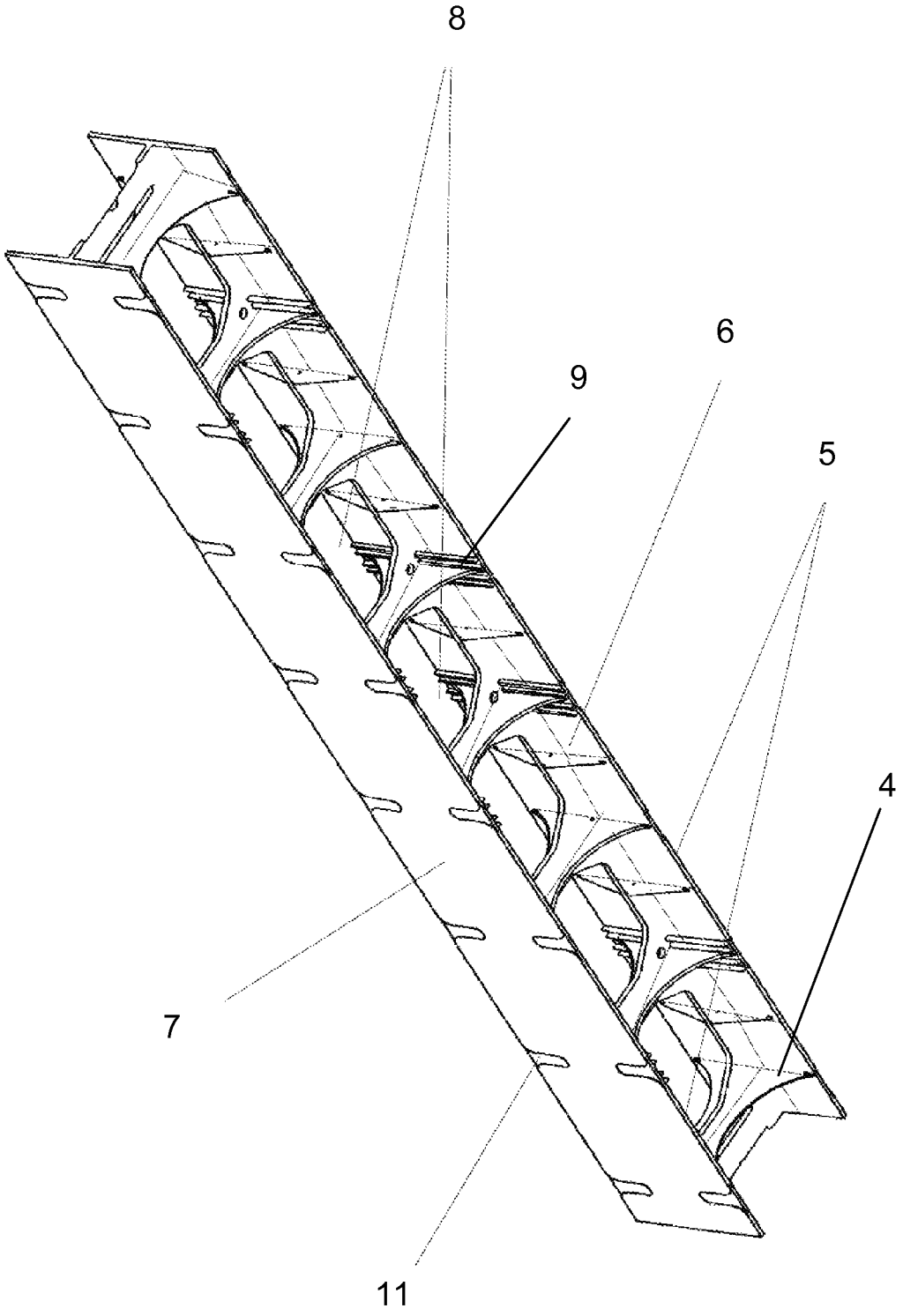
FIG. 2 is a perspective view of the wall stud shown in FIG. 1.

FIGS. 1 and 2 show a wall stud according to a preferred embodiment of the present invention. The wall stud 1 is used for positioning between an opposing pair of formwork boards to ensure the resulting wall is of a uniform thickness and to keep the formwork boards in place while material is being placed between the formwork boards. The wall stud 1 includes a body 3 and two side walls 5 located on opposing sides of the body. Each side wall 5 has an inner face 6 and outer face 7. The wall stud also may have two joiner sections 10. The stud body 3 has at least one opening 8 adapted to receive at least one reinforcing rod. The outer face 7 of the side walls 5 is securable to the formwork board. The joiner sections 10 are adapted to receive a stud joiner clip 22 (shown in FIGS. 6 to 7) for securing said wall stud to another wall stud.

Figure 3:
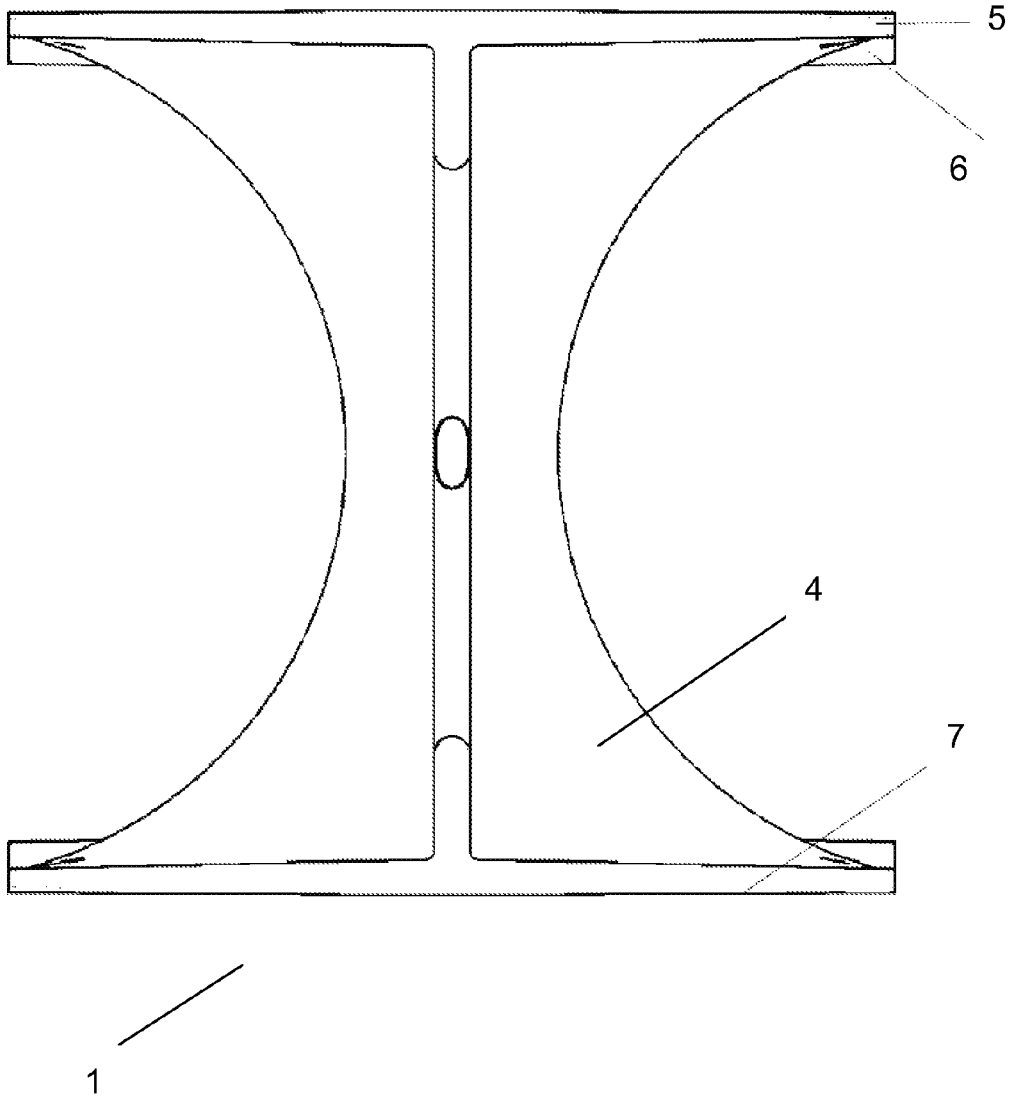
FIG. 3 is a top view of the wall stud shown in FIG. 1.

The body 3 of the wall stud 1 is positioned such that it is in the centre of the inner faces 6 of the side walls 5, thereby forming a substantially "H" shape when viewed from above, as shown in FIG. 3. The body may be affixed or integrally formed with the side walls of the wall stud.

As shown in FIGS. 1 and 2, the body 3 of the wall stud 1 has a plurality of accurately spaced, large openings 8 for easy flow of concrete. The large openings also facilitate the accurate placement of reinforcing bars, usually horizontal reinforcing bars.

Thin ribs 4 extend from the body 3 between the inner faces 6 of the side walls 5. The portion of the ribs not bordered by the body and side walls are curved and substantially 'C' or 'U' shaped as shown in FIGS. 2 and 3. The ribs provide lateral stability are integrally formed with the body and side walls.

The outer faces 7 of the wall stud 1 are secured to the formwork boards using an adhesive, for example, glue. The outer face 7 can be etched or roughened in some way, for example by sanding. This allows for better glue adhesion between the outer face of the wall stud and the formwork board. Since the outer face is rough and not smooth, there is greater surface area for the glue to cover or adhere to; in addition, the glue can seep into crevices on the stud side wall for better adhesion to the formwork board.

The outer face 7 of the stud side wall 5 may also have at least one cut away part 11 as shown in FIG. 2, preferably the cut away part is in a dovetail shape. This cut away or under cut part also aids better glue adhesion between the outer face 7 of the stud 1 and the formwork board.

Figure 4:
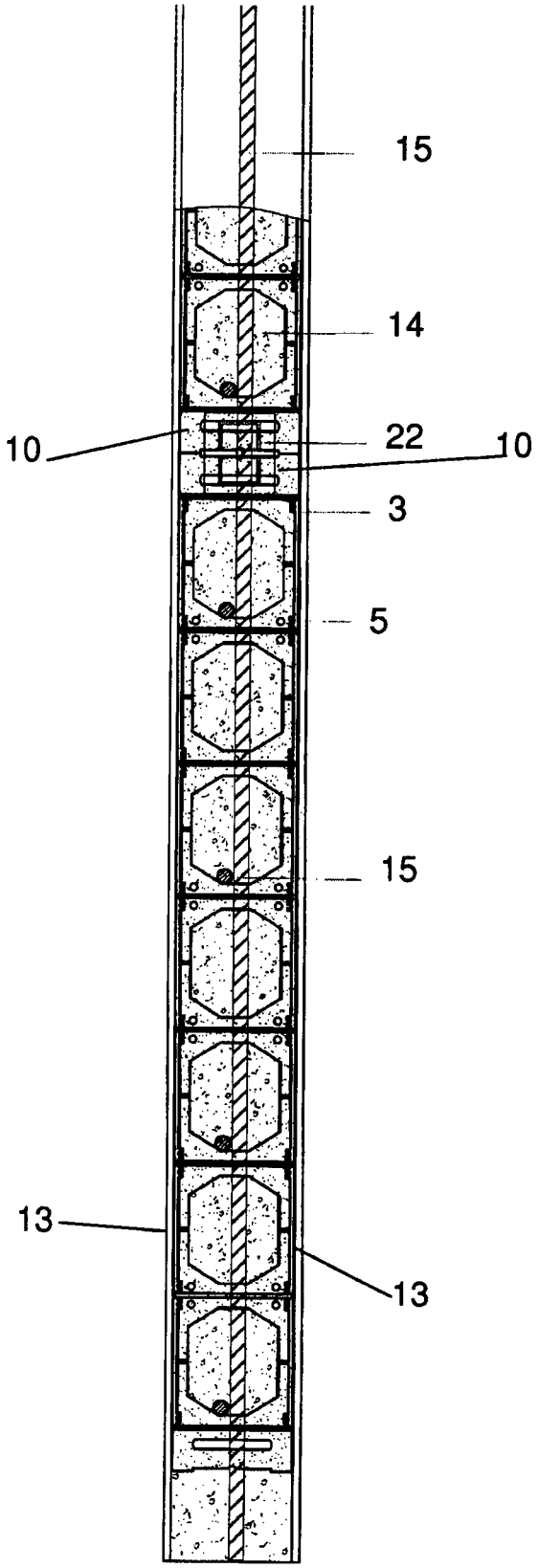
FIG. 4 is a front cross-sectional view of the wall stud shown in FIG. 1 in use in a wall construction.
Figure 5:
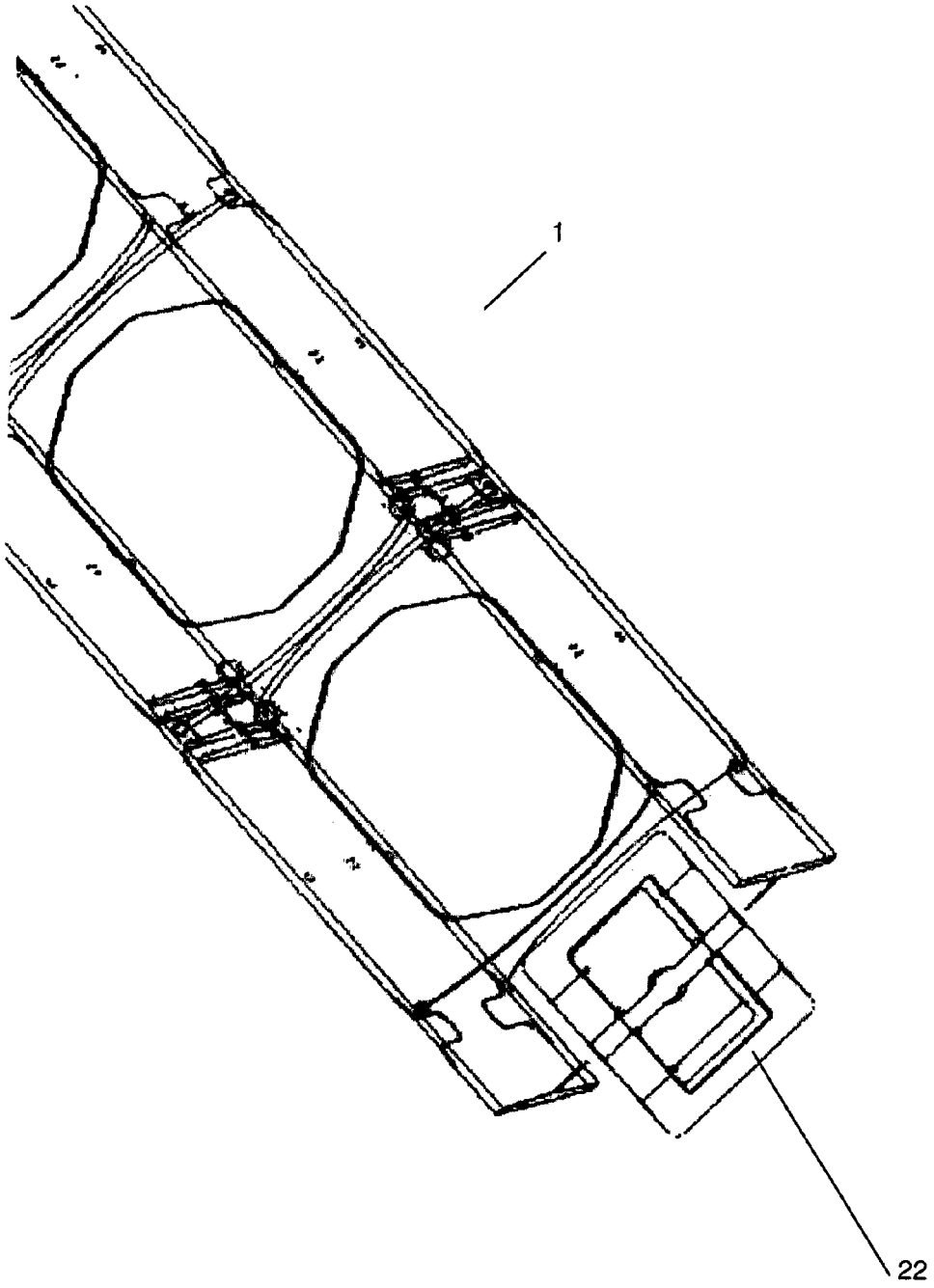
FIG. 5 is a perspective view of part of the wall stud shown in FIG. 1 with a stud joiner clip attached.

Wall studs are often manufactured in many standard sizes. When constructing a low wall, only one regular stud may be needed. However, for a taller wall an extra long stud or many regular sized studs are often needed. In conventional methods of wall construction it is difficult to ensure studs placed above one another are correctly aligned and stable. As seen in FIGS. 4 and 5, the wall stud 1 can be easily joined to another stud by a stud joiner clip 22. One end of the stud joiner clip 22 is attached to a joiner section 10 of the wall stud 1. The other end of the stud joiner clip 22 is attached to a joiner section 10 of another wall stud. It does not matter which end of the wall stud or which joiner section the joiner clip 22 is attached to because the wall stud is symmetrical. In this way, two or more wall studs can be secured or locked together as though they were one long stud.

Preferably the wall stud and stud joiner clip are made of polymer and more preferably plastic. This system is therefore very lightweight and thus easy to install. Furthermore, polymer and plastic does not react with the concrete or other materials used to create the wall. Therefore, the wall studs, wall stud spacers, and wall stud joiner clips of the present invention do not rust or corrode over time.

A wall stud assembly includes a wall stud as described above and may further include a stud joiner clip for securing the joiner section of the wall stud to another wall stud.

Figure 9:
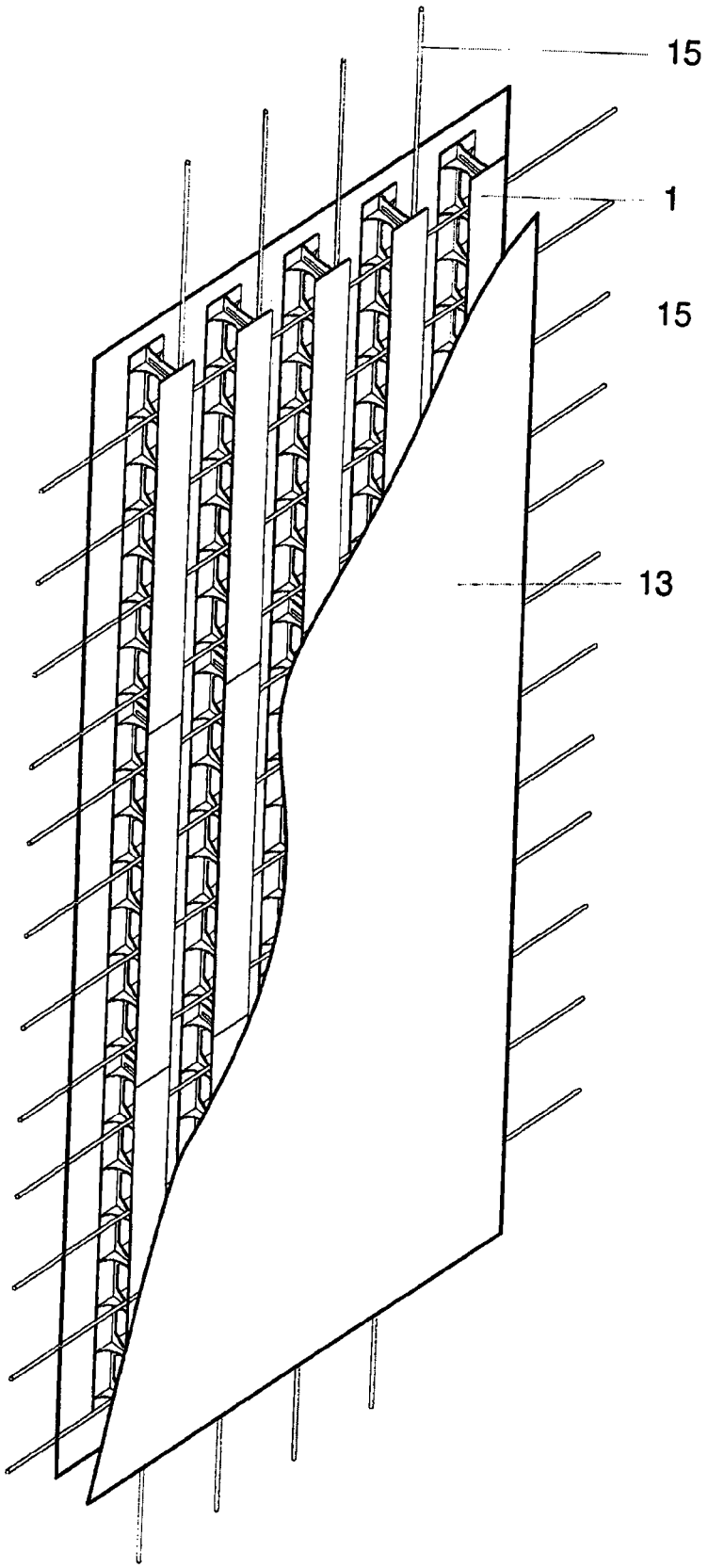
FIG. 9 is a partial cut-away perspective view of the wall stud in use in a wall construction.

A formwork structure can be pre-assembled and transported to a worksite, alternatively it can be built on the worksite if required. FIG. 4 and FIG. 9 show part of a wall constructed according to the present invention. The formwork structure includes an opposing pair of formwork boards 13 and at least one wall stud assembly as described above located in spaced relationship between the formwork boards.

In constructing a wall, as shown in FIGS. 4 and 9, at least one formwork structure as described above is erected. Further, stud joiner clips may be used to join more than one stud together at the joiner sections 10 of the wall stud 1 in the formwork structure. Reinforcing rods 15 are placed through the openings of the wall stud body 3. The cavity in between the formwork boards is then filled with wall material 14, preferably concrete. The formwork boards, held in place by the studs, remain in place after being filled with concrete or other material acting as the finished internal or external wall surface.

This arrangement is lightweight which makes the formwork boards and their installation very easy and quick. This arrangement also facilitates the flow of concrete around the reinforcing bars thereby minimising voids and ensuring maximum strength for the concrete wall. Distortion or twisting of the formwork panels, that the studs are connected to, is prevented because of the unique "H-shaped" cross-sectional stud which provides rigidity between the formwork boards.

The wall studs create a rigid wall panel prior to concrete pouring, which prevents twisting and shear movement of the formwork structure.

Furthermore, the cavities in the body of the stud allows accurate placement of the reinforcing bars, to ensure proper concrete coverage of the bars.

Figure 10:
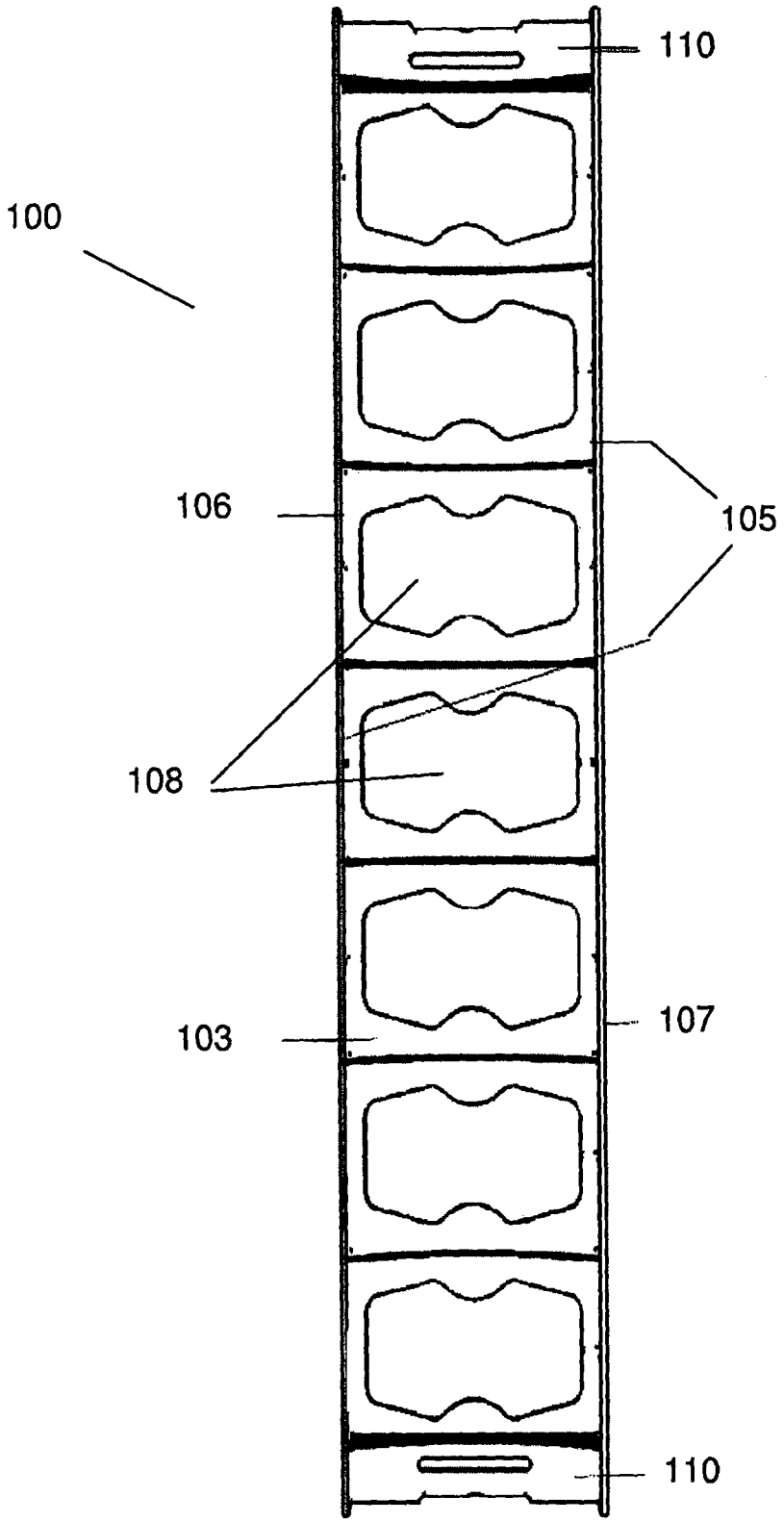
FIG. 10 is a front view of a wall stud in accordance with another embodiment of the present invention.
Figure 11:
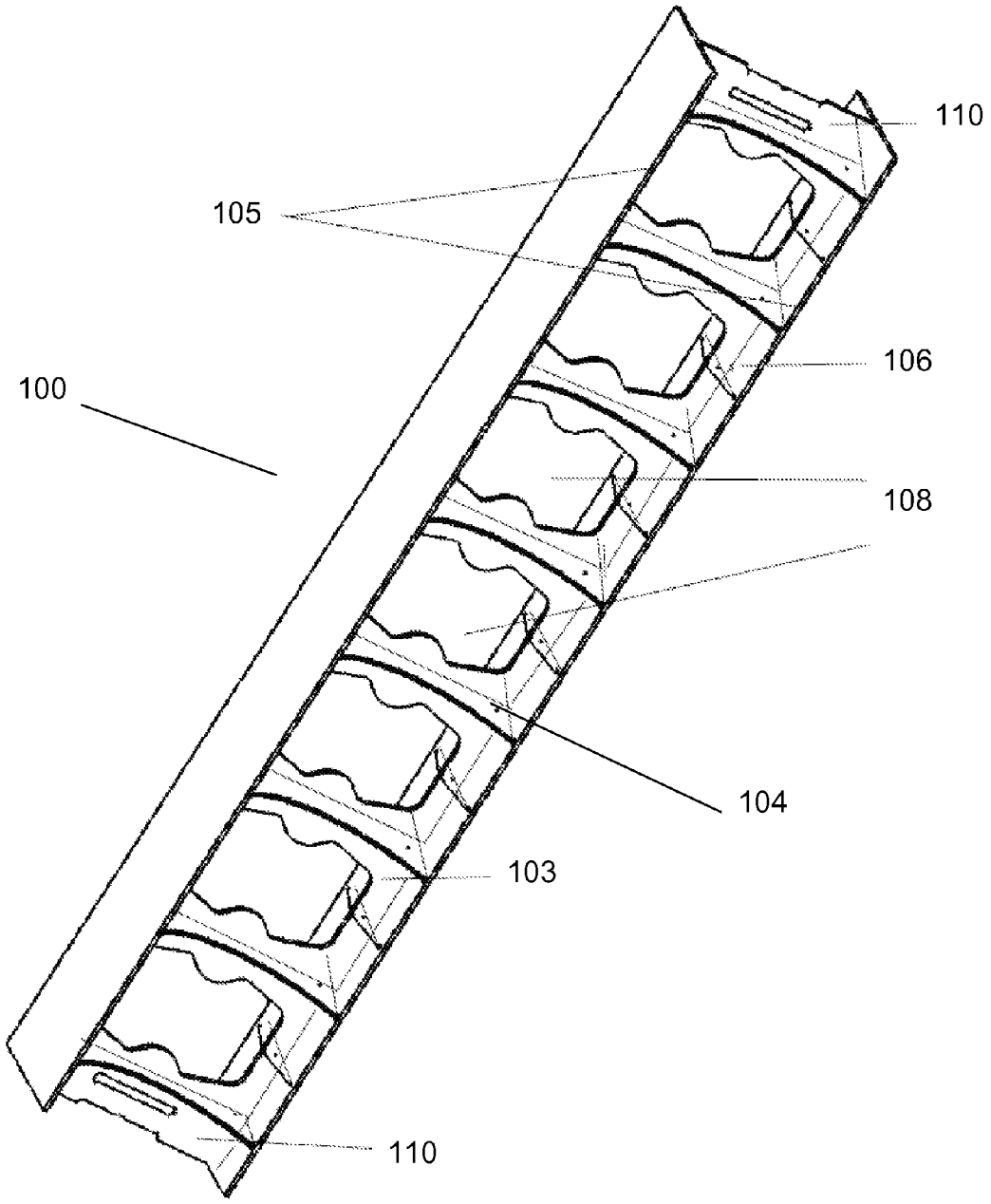
FIG. 11 is a perspective view of the wall stud shown in FIG. 10.
Figure 12:
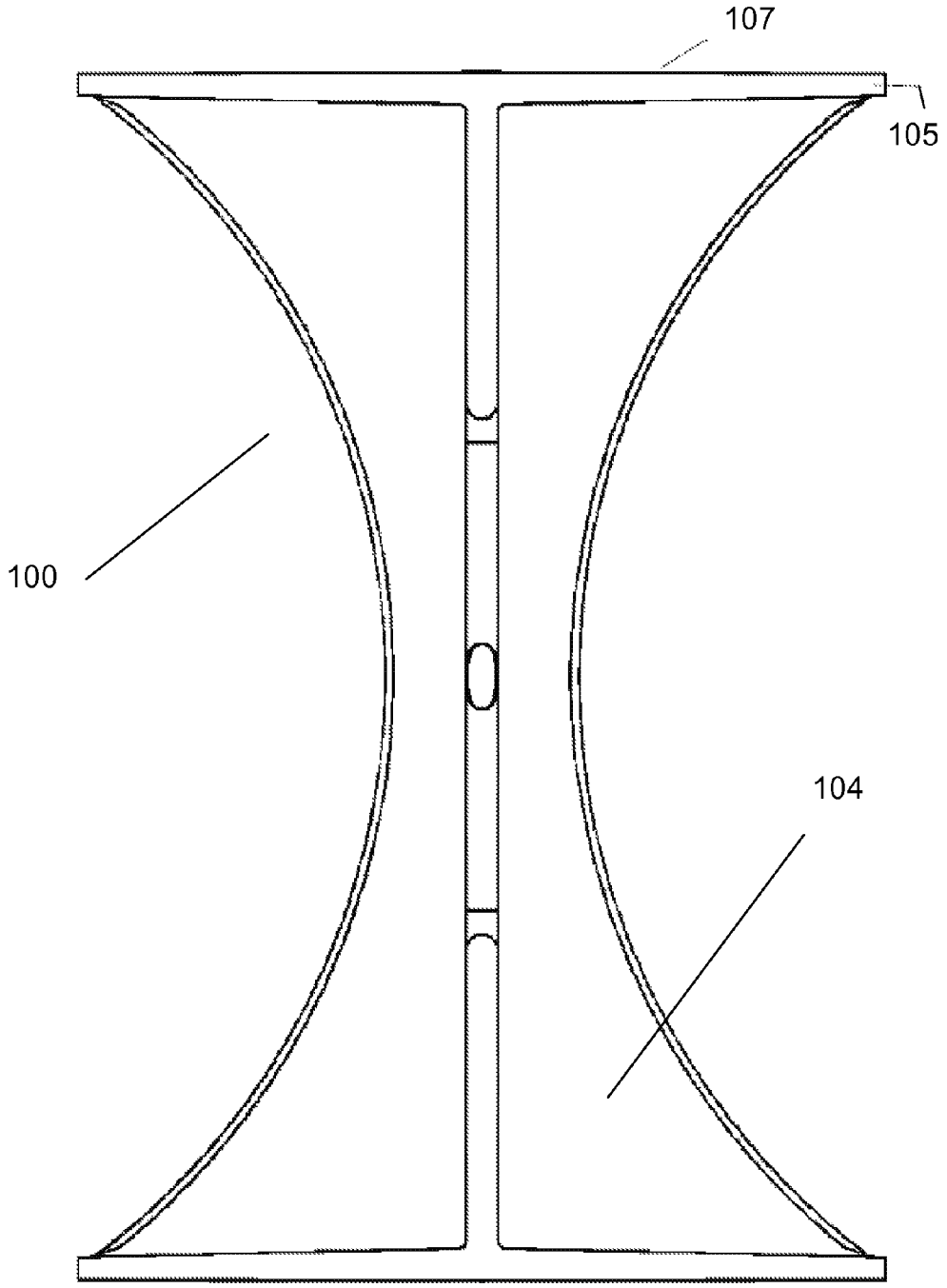
FIG. 12 is a top view of the wall stud shown in FIG. 10.

FIGS. 10, 11 and 12 show another embodiment of the present invention. This embodiment of the wall stud 100 also includes a body 103 and two side walls 105 located on opposing sides of the body, each having an inner face 106 and outer face 107. The wall stud 100 also may have two joiner sections 110. The stud body 103 has at least one opening 108 adapted to receive at least one reinforcing rod. Thin ribs 104 extend from the body 103 between the inner faces 106 of the side walls 105. The portion of the ribs 104 not bordered by the body and side walls are curved and substantially 'C' or 'U' shaped as shown in FIGS. 11 and 12.

The outer face 107 of the side walls 105 is securable to the formwork board. The joiner sections 110 are adapted to receive a stud joiner clip (not shown) for securing said wall stud to another wall stud.

Figure 6:
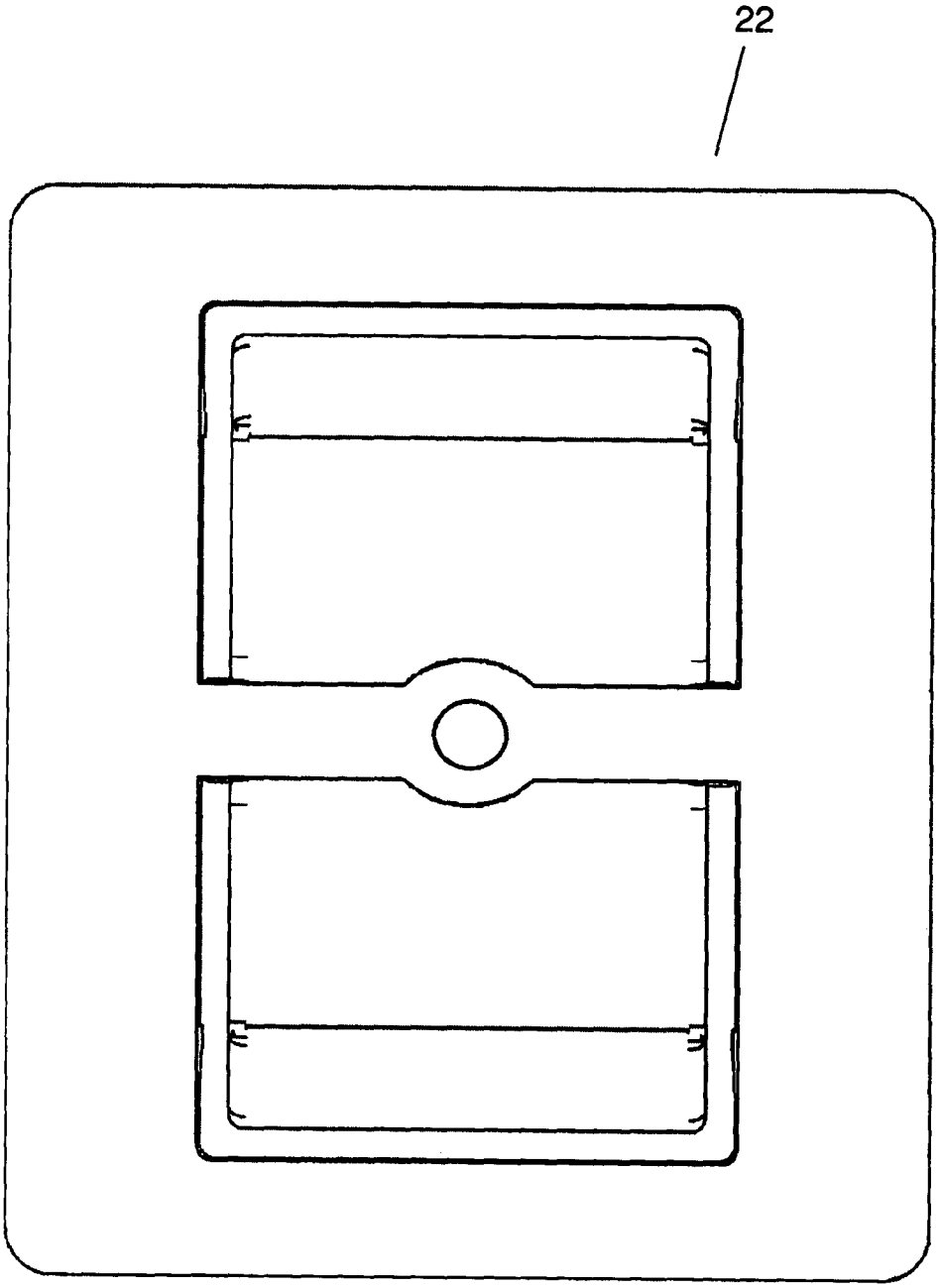
FIG. 6 is a front perspective view of a stud joiner clip.
Figure 7:
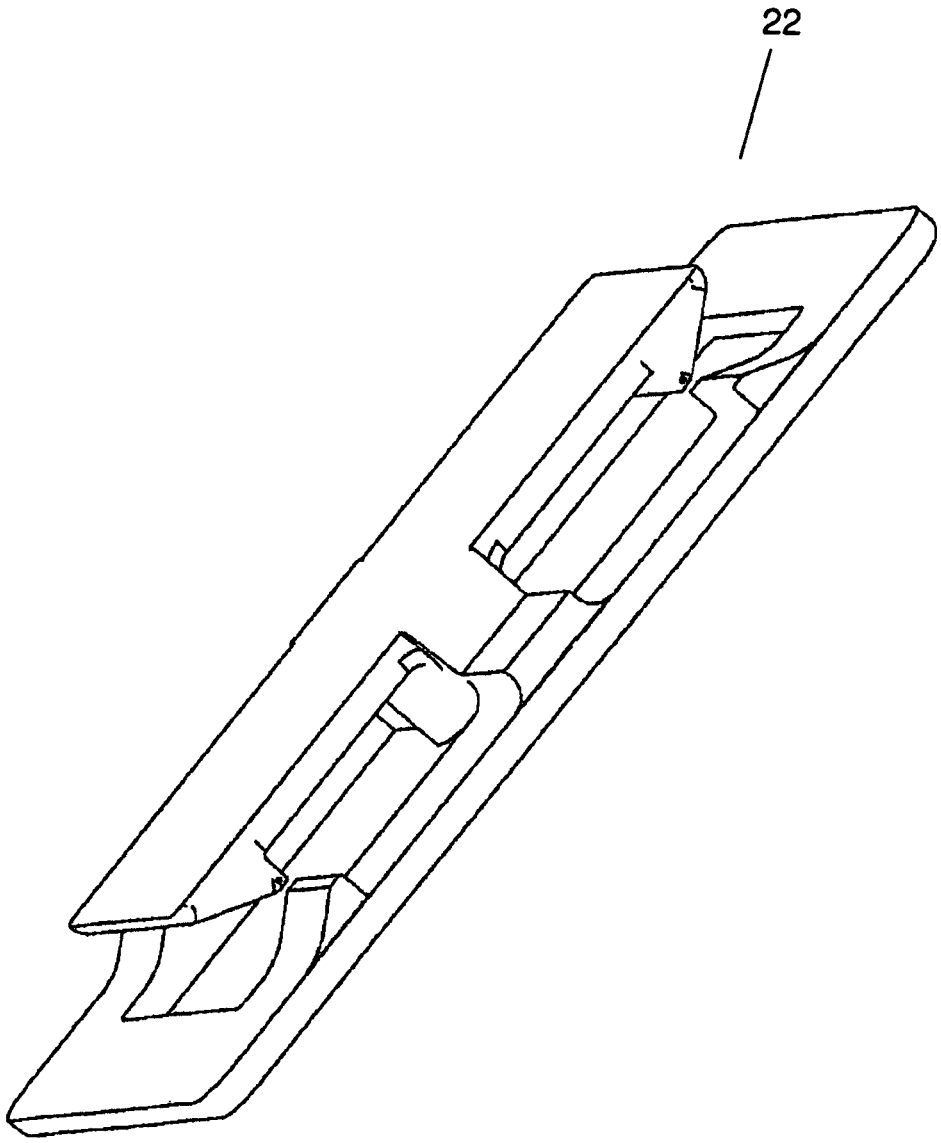
FIG. 7 is a rear perspective view of the stud clip illustrated in FIG. 6.

The large openings 108 or cavities in the body 103 of the stud also have an open symmetrical shape. The wall stud 100 in this embodiment also has a frame which is a substantially "H" cross-sectional shape. As is illustrated in this embodiment, the openings 108 can be of any symmetrical open shape which are adapted to receive and accurately place at least one reinforcing rod and allows wall material to be poured into, and flow freely between the studs. This invention overcomes a number of the disadvantages of other wall construction methods and systems. One of the most advantageous features of this wall construction system is that all the elements used to construct a wall are symmetrical. As shown in the figures, the wall stud 1, 100 is symmetrical, having a substantially "H" horizontal cross-section. The wall stud joiner clip 22 is also symmetrical as shown in FIGS. 5 through 7. Because each element is symmetrical, it means that no element can be placed incorrectly in the formwork. This reduces delays associated with having to dismantle and correctly position the formwork. It also means that less skilled workers or even the home handyman are able to easily use such a system to construct a wall. Furthermore, it simplifies manufacture of each element and therefore reduces cost.

In comparison to constructing a wall using other methods and systems, this method is easier, more accurate and more robust. In existing systems which use plastic spacers there is not enough safety margin during concrete pour in high labour cost countries. For example in the boxed spacer system, boxed spacers can be placed 90 degrees out of line making it difficult to place the reinforcing bars in the formwork. Also the boxed spacer method for constructing a wall requires a disposable template for accurate positioning of boxed spacers and this method is difficult to automate and streamline.

The present invention overcomes this disadvantage because all the elements are symmetrical making it very easy and quick to place the elements correctly together.

This system and method is more robust during concrete pour than those of the prior art. This is because the studs are essentially continuous and therefore a greater area of formwork board is protected by the stud, where the stud side wall is in contact with the formwork board, than some other methods and systems; particularly, compared to the boxed spacer wall constructions.

A pre-packaged wall construction kit including a plurality of wall studs as described above and a plurality of wall stud clips as described above may be used.

In another embodiment, the inner face 6 of the side walls 5 are adapted to receive a stud spacer 23 (shown in FIG. 8) for securing a pair of wall studs in a spaced relationship. As shown in FIGS. 1, 2, and 5, the inner face 6 of the side wall 5 has at least one set of guides 9 to receive and hold a stud spacer 23. A stud spacer inserted into the guides is not depicted.

During wall construction the stud spacer 23 may assist separation of the wall studs accurately placing them between the formwork boards. The stud spacers have an opening for accurately holding reinforcing bars in place.

Figure 8:
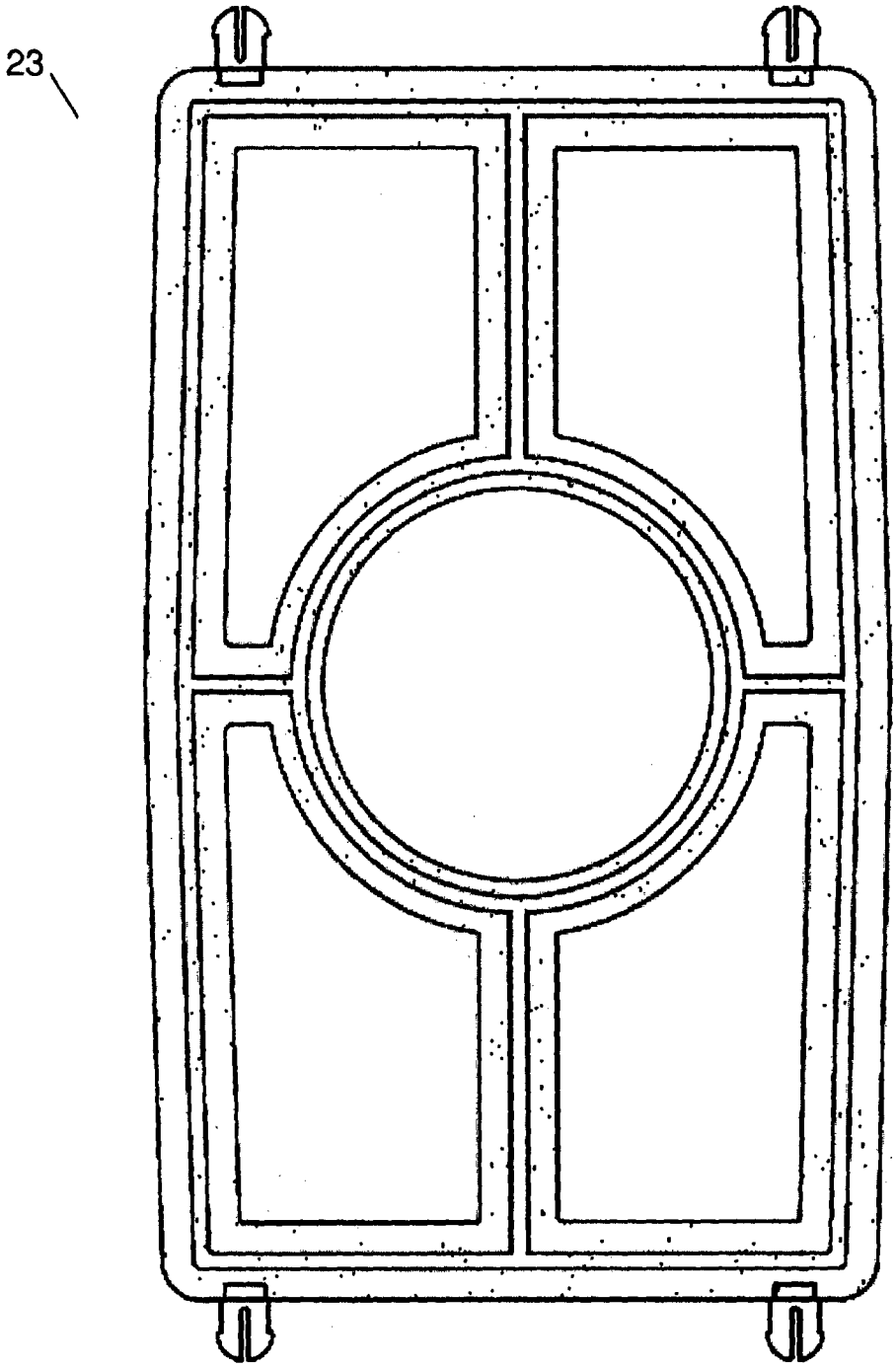
FIG. 8 is a top view of a stud spacer in accordance with another embodiment of the invention.

The wall stud spacer 23 is also symmetrical as shown in FIG. 8. Preferably the wall stud spacer is also made of polymer and more preferably plastic.

In another embodiment, the wall stud assembly may further include a wall stud spacer for securing a pair of wall studs in a spaced relationship. The stud spacer is adapted to receive at least one reinforcing rod (which is vertical or horizontal depending on the orientation of the formwork).

In constructing a wall, the wall studs are secured accurately in place by a plurality of stud spacers. Reinforcing rods 15 are placed through the openings of the wall stud body 3 and the wall stud spacer 23. The cavity in between the formwork boards is then filled with wall material 14, preferably concrete. The formwork boards, held in place by the studs and spacers, remain in place after being filled with concrete or other material acting as the finished internal or external wall surface.

The wall stud spacer in this embodiment further assists to hold the studs accurately in position, ensuring no distortion or twisting of the formwork panels. The studs and spacers create a rigid wall panel prior to concrete pouring, which prevents twisting and shear movement of the formwork structure.

The spacers may also assist to accurately place the reinforcing bars (usually vertical bars) inside the wall. The open structure of the spacers allows concrete to flow more easily between the separated formwork boards.

Further, spacers which are easily slotted into the guides on the stud can be used to arrange the studs in a spaced relationship. The spacers can then be secured to the body of the studs. This ensures the studs are accurately positioned in the formwork because the spacers are the requisite size for spacing of the studs.

It will be appreciated by persons skilled in the art that other embodiments and arrangements of the method and system are also possible within the spirit and scope of the invention described herein or as claimed in the appended claims.

The invention claimed is:

1. A wall stud for positioning between an opposing pair of formwork boards, the wall stud including a body, a plurality of ribs and two side walls located on opposing sides of the body, each side wall having an inner face and an outer face, wherein:

the body has at least one opening adapted to receive at least one reinforcing rod;

the body is positioned approximately in the center of the inner face of each side wall so that a horizontal cross-section of the stud is substantially an H shape;

each of the plurality of ribs:

is located between the inner faces of each side wall on a side of the body;

extend from the body in an orientation that is substantially perpendicular to the body; and extend from the inner faces of each side wall in an orientation that is substantially perpendicular to the inner faces of each side wall and the outer face of the side walls are securable to said formwork board.

2. A wall stud according to claim 1, wherein the body, the plurality of ribs and two side walls are integrally formed.

3. A wall stud according to claim 1 wherein the outer face of the side wall has an etched surface.

4. A wall stud according to claim 1 wherein the outer face of the side wall has at least one cut away part, preferably in the shape of a dove tail.

5. A wall stud according to claim 1 wherein the wall stud is formed from a polymer material.

6. A wall stud according to claim 1 further including two joiner sections located at opposing ends of the wall stud, for receiving a stud joiner clip for securing one said joiner section of said wall stud to a joiner section of another wall stud so that said wall studs are secured end to end.

7. A wall stud assembly including:

at least one wall stud according to claim 6; and a stud joiner clip for securing said joiner section of said wall stud to another wall stud, so that said wall studs are secured end to end.

8. A wall stud assembly according to claim 7 wherein the stud joiner clip is formed from a polymer material.

9. A method of wall construction including the steps of:

erecting at least one formwork structure including:

an opposing pair of formwork boards; and at least one wall stud according to claim 1 located in spaced relationship between the formwork boards;

placing reinforcing rods through at least one opening of each of the wall studs; and filling the cavity in between the formwork boards with wall material, preferably concrete.

10. A method of wall construction including the steps of:

erecting at least one formwork structure including:

an opposing pair of formwork boards; and at least one wall stud assembly according to claim 7 located in spaced relationship between the formwork boards;

placing reinforcing rods through at least one opening of each of the wall studs; and filling the cavity in between the formwork boards with wall material, preferably concrete.

11. A method of wall construction including the steps of:

erecting at least one formwork structure including:

an opposing pair of formwork boards; and at least one wall stud assembly according to claim 7 located in spaced relationship between the formwork boards;

securing at least a pair of said wall studs together end to end using said stud joiner clip;

placing reinforcing rods through at least one opening of each of the wall studs; and filling the cavity in between the formwork boards with wall material, preferably concrete.

12. A wall constructed according to the method of claim 9.

13. A wall stud according to claim 1 wherein a portion of each rib not bordered by the body and side walls is curved.

* * * * *